US010644430B2

(12) United States Patent
Obata et al.

(10) Patent No.: US 10,644,430 B2
(45) Date of Patent: May 5, 2020

(54) CONNECTOR AND CONNECTOR STRUCTURE

(71) Applicant: Sumitomo Wiring Systems, Ltd., Yokkaichi, Mie (JP)

(72) Inventors: Masayuki Obata, Mie (JP); Mari Teramoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/167,840

(22) Filed: Oct. 23, 2018

(65) Prior Publication Data

US 2019/0131736 A1 May 2, 2019

(30) Foreign Application Priority Data

Oct. 30, 2017 (JP) ..... 2017-209363

(51) Int. Cl.

| | |
|---|---|
| ***H01R 13/436*** | (2006.01) |
| ***H01R 13/502*** | (2006.01) |
| ***H01R 13/52*** | (2006.01) |
| *H01R 12/72* | (2011.01) |
| *H01R 27/02* | (2006.01) |
| *H01R 13/629* | (2006.01) |

(52) U.S. Cl.

CPC ..... *H01R 13/4368* (2013.01); *H01R 13/4364* (2013.01); *H01R 13/502* (2013.01); *H01R 13/5219* (2013.01); *H01R 12/724* (2013.01); *H01R 13/62938* (2013.01); *H01R 27/02* (2013.01)

(58) Field of Classification Search

CPC ..... H01R 13/4368; H01R 13/5202; H01R 13/5205; H01R 13/5219; H01R 13/5221

USPC ..... 439/271

See application file for complete search history.

(56) References Cited

U.S. PATENT DOCUMENTS

| | | | | |
|---|---|---|---|---|
| 5,713,761 | A * | 2/1998 | Okayasu | H01R 13/4364 439/271 |
| 6,638,109 | B2 * | 10/2003 | Kurimoto | H01R 13/4362 439/595 |
| 7,114,991 | B2 * | 10/2006 | Shiga | H01R 13/5208 439/587 |
| 7,252,547 | B2 * | 8/2007 | Nishide | H01R 13/62938 439/275 |
| 7,481,675 | B2 * | 1/2009 | Patterson | H01R 13/5205 439/148 |

(Continued)

FOREIGN PATENT DOCUMENTS

| | | |
|---|---|---|
| JP | 2016-91761 | 5/2016 |

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

Both a non-waterproof connector (10) and a waterproof connector (10A) include a housing (20, 20A) having a retainer mounting hole (24) open in an outer surface, and a retainer (60) to be inserted into the retainer mounting hole (24). In the waterproof connector (10A), a seal ring (210) is fit on a rear side of the outer surface of the housing (20A), out of both front and rear sides across an opening of the retainer mounting hole (24). In the non-waterproof connector (10), restricting portions (38) are provided to project on the rear side of the outer surface of the housing (20). The restricting portions (38) can come into contact with an inner surface on an opening side of a receptacle (122) in a fitting state.

7 Claims, 10 Drawing Sheets

(56) References Cited

U.S. PATENT DOCUMENTS

| | | | | |
|---|---|---|---|---|
| 8,272,895 | B2 * | 9/2012 | Park | H01R 13/521 439/587 |
| 8,684,773 | B2 * | 4/2014 | Kobayashi | H01R 13/4362 439/752 |
| 9,178,301 | B2 * | 11/2015 | Shiga | H01R 13/5208 |
| 9,231,348 | B2 * | 1/2016 | Kanemura | H01R 13/4368 |
| 9,515,413 | B2 * | 12/2016 | Kataoka | H01R 13/5202 |
| 2002/0002000 | A1 * | 1/2002 | Okamura | H01R 13/5208 439/587 |
| 2002/0076995 | A1 * | 6/2002 | Kurimoto | H01R 13/4362 439/752 |
| 2002/0127913 | A1 * | 9/2002 | Ichio | H01R 13/4361 439/595 |
| 2008/0233778 | A1 * | 9/2008 | Moll | H01R 13/7032 439/188 |
| 2008/0233784 | A1 * | 9/2008 | Patterson | H01R 13/5205 439/278 |
| 2015/0079827 | A1 * | 3/2015 | Hara | H01R 13/05 439/188 |
| 2015/0140847 | A1 * | 5/2015 | Kanemura | H01R 13/4368 439/259 |
| 2015/0318639 | A1 * | 11/2015 | Hara | H01R 13/639 439/345 |
| 2016/0064851 | A1 * | 3/2016 | Kataoka | H01R 13/5202 439/587 |
| 2017/0033492 | A1 * | 2/2017 | Hara | H01R 4/18 |
| 2017/0222354 | A1 * | 8/2017 | Hashimoto | H01R 13/5025 |
| 2017/0222356 | A1 * | 8/2017 | Hashimoto | H01R 13/5208 |
| 2017/0222358 | A1 * | 8/2017 | Hashimoto | H01R 11/11 |
| 2017/0288334 | A1 * | 10/2017 | Moriyasu | H01R 13/521 |
| 2017/0310040 | A1 * | 10/2017 | Gagnon | F16J 15/06 |

* cited by examiner

CONNECTOR AND CONNECTOR STRUCTURE

BACKGROUND

Field of the Invention

The invention relates to a connector and a connector structure.

Related Art

Japanese Unexamined Patent Publication No. 2016-91761 discloses a waterproof connector with a housing including cavities into which terminal fittings are insertable. A retainer mounting hole is open in the upper surface of the housing and communicates with each cavity. A rubber ring is to be fit on a rear side of the outer surface of the housing across the retainer mounting hole.

A retainer is inserted and held in the retainer mounting hole of the housing and retains the terminal fitting in each cavity. A pressing portion of the retainer projects through the opening of the retainer mounting hole on the upper surface of the housing. The rubber ring fit on the housing is rearward of the pressing portion and functions to seal between the housing and a receptacle while suppressing rattling by resiliently contacting an inner surface on an opening side of the receptacle in a fitting state.

The above waterproof connector may be required to have a configuration applicable to a non-waterproof connector without changing a basic configuration thereof. In this case, if some components such as a retainer can be used commonly between the waterproof connector and the non-waterproof connector, a new mold for molding the retainer and the like need not be prepared, which is favorable.

In changing the specifications of the waterproof connector to non-waterproof specifications, the rubber ring is not necessary. However, if the rubber ring is detached from the outer surface of the housing, a step corresponding to a thickness of the detached rubber ring is formed between an opening end part of the receptacle and the outer surface of the housing. Thus, the receptacle and the housing may rattle against each other.

The invention was completed on the basis of the above situation and aims to provide a connector capable of suppressing rattling even if specifications are changed to non-waterproof specifications.

SUMMARY

The invention is directed to a connector with a housing to be fit into a receptacle of a mating housing from the front and includes a cavity into which a terminal fitting is insertable. A retainer mounting hole is open in an outer surface of the housing and communicates with the cavity. A retainer is to be inserted into the retainer mounting hole and is configured to retain and lock the terminal fitting in the cavity. A restricting portion projects on a rear side of the outer surface of the housing, out of both front and rear sides across an opening of the retainer mounting hole, and is configured to contact an inner surface on an opening side of the receptacle in a fitting state.

Further, the invention also is directed to a connector structure with a non-waterproof connector and a waterproof connector. Both the non-waterproof connector and the waterproof connector have a housing to be fit into a receptacle of a mating housing from the front and include a cavity into which a terminal fitting is insertable. A retainer mounting hole is open in an outer surface of the housing and communicates with the cavity. A retainer is inserted into the retainer mounting hole and is configured to retain and lock the terminal fitting in the cavity. The non-waterproof connector further includes a restricting portion projecting on a rear side of the outer surface of the housing and can contact an inner surface on an opening side of the receptacle in a fitting state. The waterproof connector further includes a seal ring to be fit on the rear side of the outer surface of the housing and resiliently contact an inner surface on an opening side of the receptacle in a fitting state. The respective retainers of the non-waterproof connector and the waterproof connector have the same shape.

In the waterproof connector, the seal ring is fit on the outer surface of the housing to provide sealing between the housing and the receptacle. In the case of changing the waterproof connector to have non-waterproof specifications, the seal ring fit on the rear side of the outer surface of the housing (hereinafter, referred to as a "rear side of the retainer mounting hole") is unnecessary. In changing to the non-waterproof specifications, a clearance may be formed between the inner surface on the opening side of the receptacle in the fitting state and the rear side of the retainer mounting hole. Thus, the receptacle and the housing may rattle against each other. However, in the present invention, the restricting portion projects on the rear side of the retainer mounting hole and is arranged to contact the inner surface on the opening side of the receptacle in the fitting state. Thus, rattling of the receptacle and the housing can be suppressed.

According to the above configuration, the non-waterproof connector can be configured without being accompanied by shape changes of parts other than the rear side of the retainer mounting hole, and the retainer can have the same shape and be commonly used between the non-waterproof connector and the waterproof connector. As a result, in changing the waterproof connector to have the specifications of the non-waterproof connector, it is not necessary to prepare a new mold for molding the retainer for non-waterproof connector and cost can be reduced.

A front mask may be mounted on the housing to cover an area on the front side of the outer surface of the housing. Even if the waterproof connector is changed to have the non-waterproof specifications, the structure of the area on the front side of the housing need not be changed. Thus, the front mask can have the same shape and can be used commonly between the waterproof connector and the non-waterproof connector so that cost can be reduced. Further, the lever can have the same shape and can be used commonly between the waterproof connector and the non-waterproof connector.

Plural restricting portions are provided at intervals in a circumferential direction on the outer surface of the housing to suppress rattling of the connector in all directions.

A retracting surface chamfered is provided on a front surface of the restricting portion. According to this configuration, the butting of an opening end part of the receptacle against the front surface of the restricting portion in the process of connecting the housings is prevented. As a result, a connecting operation of the housings can proceed smoothly. Further, for example, if the opening end part of the receptacle slides along the retracting surface of the restricting portion, the inclination of the receptacle can be corrected.

DETAILED DESCRIPTION

One embodiment is described with reference to the drawings. This embodiment includes a non-waterproof connector 10 and a waterproof connector 10A, and either one of the connectors 10, 10A can be selected and used according to user needs for non-waterproof specifications or waterproof specifications. A mating connector 100 serving as a connection partner has substantially the same shape for both the non-waterproof connector 10 and the waterproof connector 10A. Note that, in the following description, surfaces of the connector (non-waterproof connector 10, waterproof connector 10A) and the mating connector 100 facing each other at the start of connection are referred to as front ends.

[Mating Connector 100]

Figure 2:
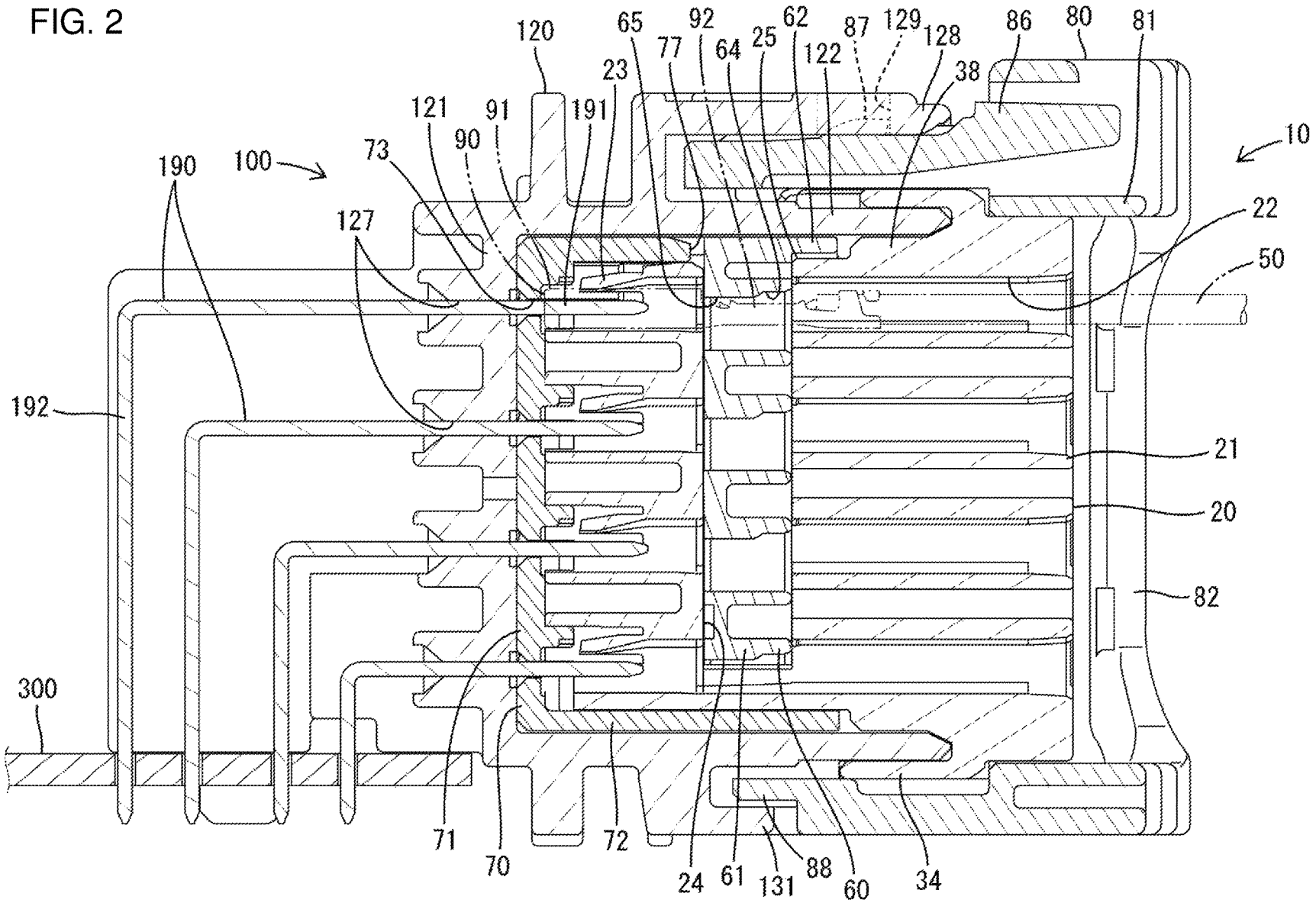
FIG. 2 is a section showing a state where the non-waterproof connector and a mating connector are properly connected.
Figure 10:
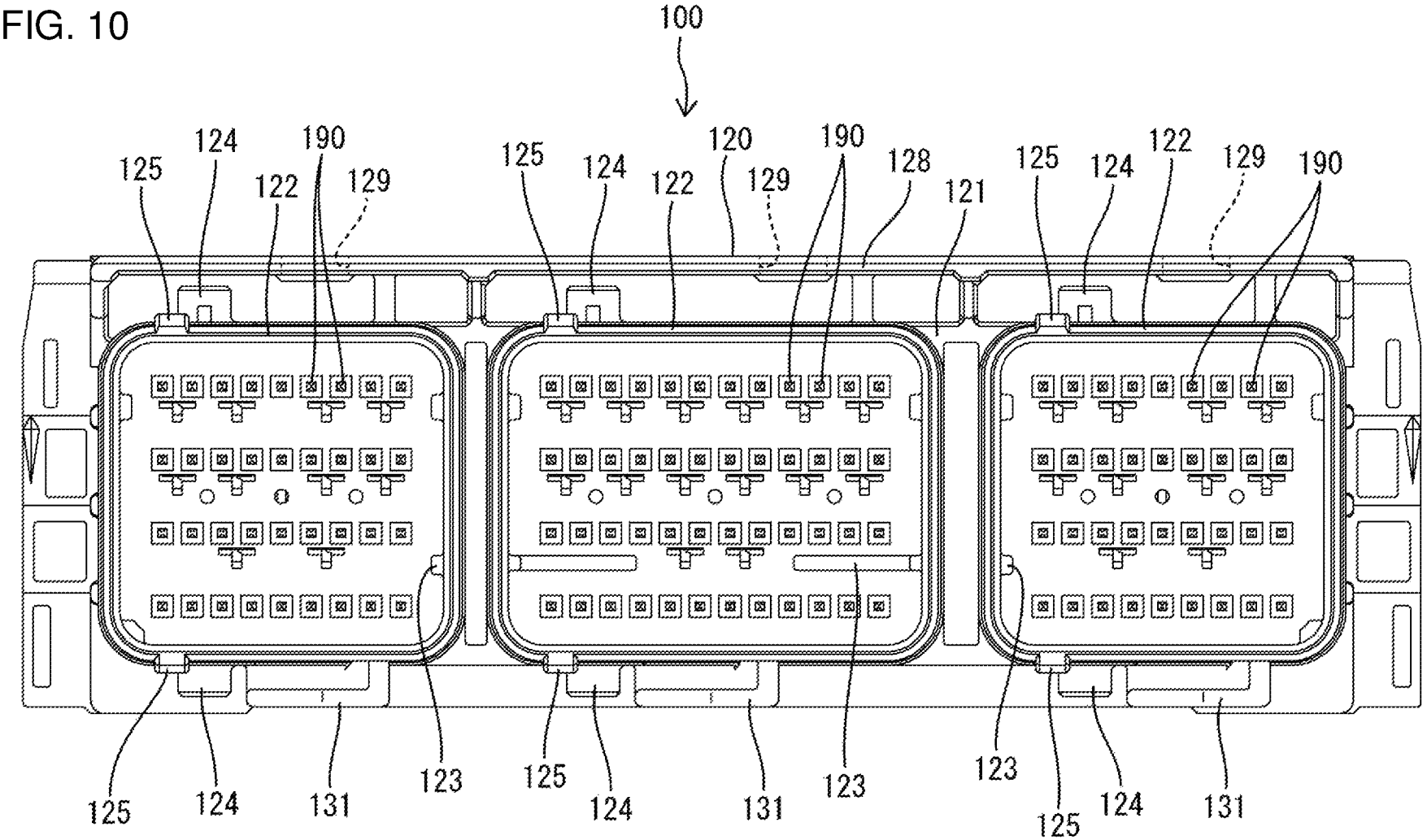
FIG. 10 is a front view of the mating connector.

As shown in FIG. 10, the mating connector 100 includes a mating housing 120 and mating terminal fittings 190. The mating housing 120 is made of synthetic resin and includes, as shown in FIG. 2, a base 121 in the form of a back plate extending along a lateral direction and to be mounted on a printed circuit board 300 and receptacles 122 projecting forward from the base 121. As shown in FIG. 10, three receptacles 122 are arranged laterally side by side. Projections 123 are provided on both left and right sides of the inner surface of each receptacle 122. The projections 123 are in a different arrangement for each receptacle 122.

Figure 3:
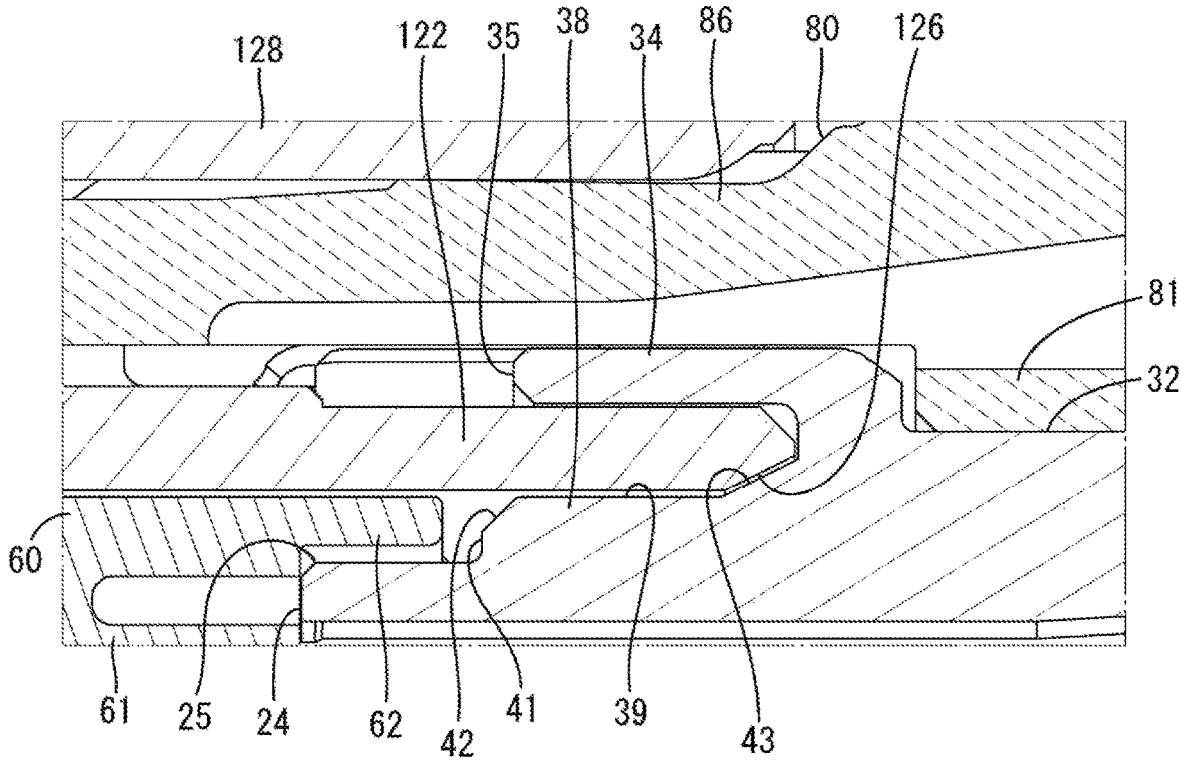
FIG. 3 is a partial enlarged view of FIG. 2.

Two cylindrical cam followers 124 project on both upper and lower sides of the outer surface of each receptacle 122. Each cam follower 124 is arranged eccentrically from a lateral center of the corresponding receptacle 122. Further, two releasing portions 125 in the form of flat ribs project substantially in front of the respective cam followers 124 on the upper and lower sides of the outer surface of each receptacle 122. As shown in FIG. 3, a tapered guiding surface 126 for guiding a housing 20 to be described later is provided on the inner surface of a front part (opening end part) of the receptacle 122.

As shown in FIG. 2, holes 127 are provided in alignment in the base 121, and the mating terminal fitting 190 is press-fit and held in each hole 127.

The mating terminal fitting 190 is made of conductive metal and is L-shaped in a side view. More particularly, the mating terminal fitting 190 includes a terminal connecting portion 191 extending along a front-rear direction and a board connecting portion 192 extending along a vertical direction. The terminal connecting portion 191 is arranged to project into the receptacle 122 through the hole 127 of the base 121. The board connecting portion 192 hangs down from a position behind the base 121 and a lower end part thereof is electrically connected to a conductive part of the printed circuit board 300.

An upper cover 128 projects forward on an upper end part of the base 121. The upper cover 128 is a flat plate substantially parallel to the upper surface of the receptacle 122 and includes three lock holes 129 at positions corresponding to the respective receptacles 122. Three lower covers 131 project forward at positions corresponding to the respective receptacles 122 on a lower end part of the base 121. Each lower cover 131 includes a horizontal part substantially parallel to the lower surface of the receptacle 122 and a vertical part connected to the lower surface of the receptacle 122 and is L-shaped in a front view.

[Non-Waterproof Connector 10]

Figure 1:
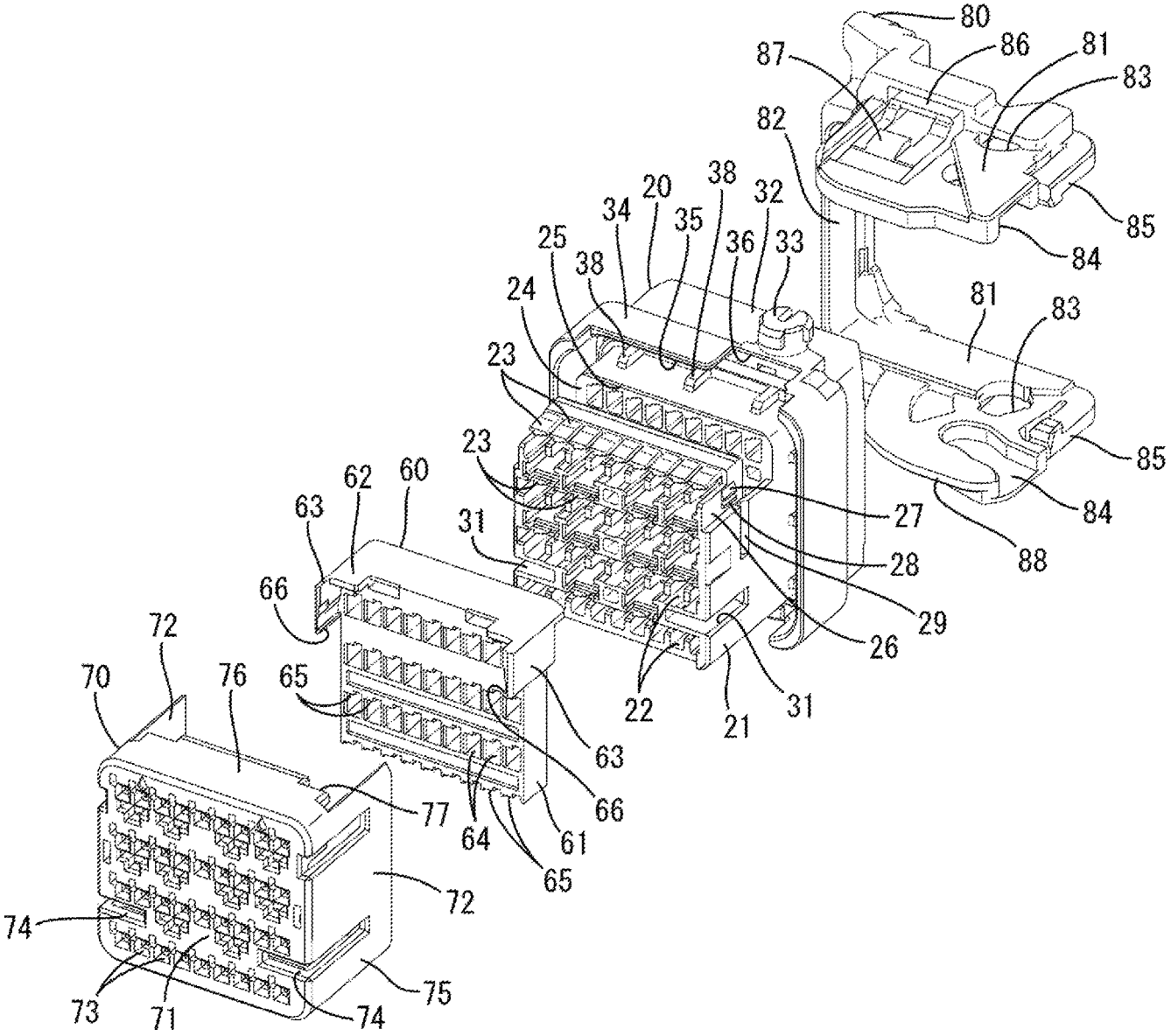
FIG. 1 is an exploded perspective view of a non-waterproof connector in one embodiment.

As shown in FIG. 1, the non-waterproof connector 10 includes the housing 20, a retainer 60, a front mask 70, a lever 80 and terminal fittings 90 (see FIG. 2). The housing 20 is fit into the left receptacle 122 of the mating connector 100, as shown in FIG. 10.

Figure 4:
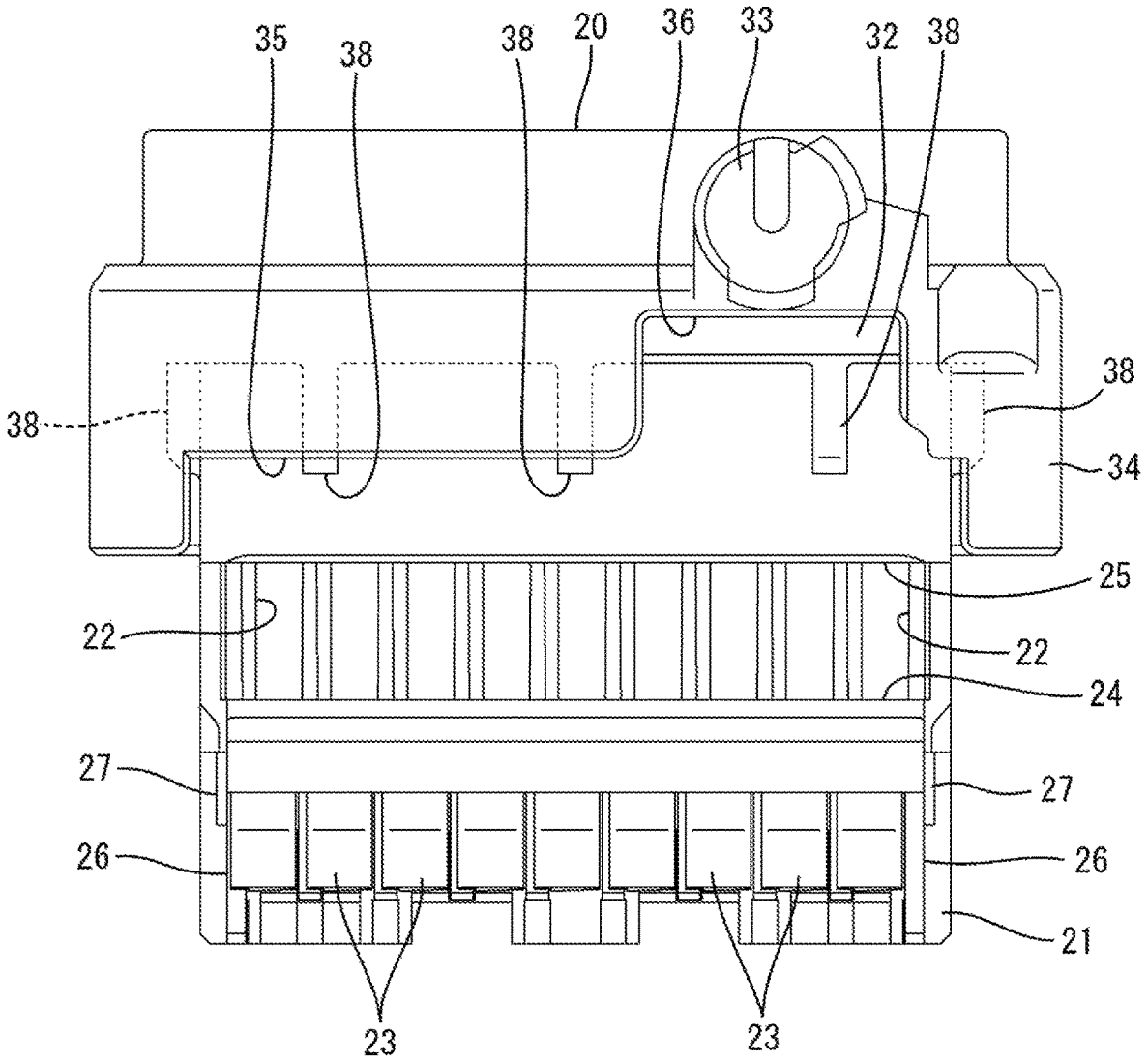
FIG. 4 is a plan view of a housing of the non-waterproof connector.
Figure 5:
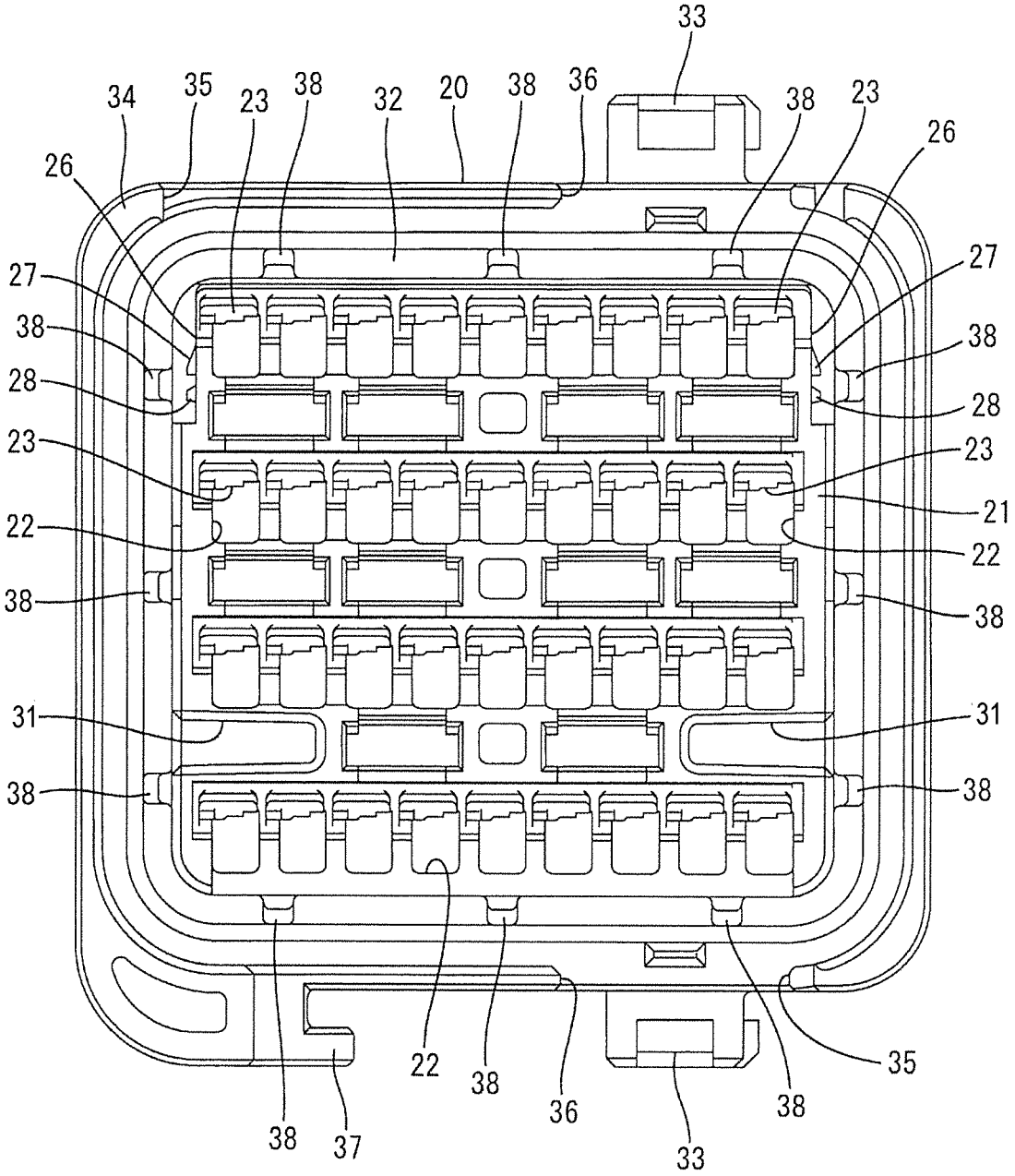
FIG. 5 is a front view of the housing of the non-waterproof connector.
Figure 6:
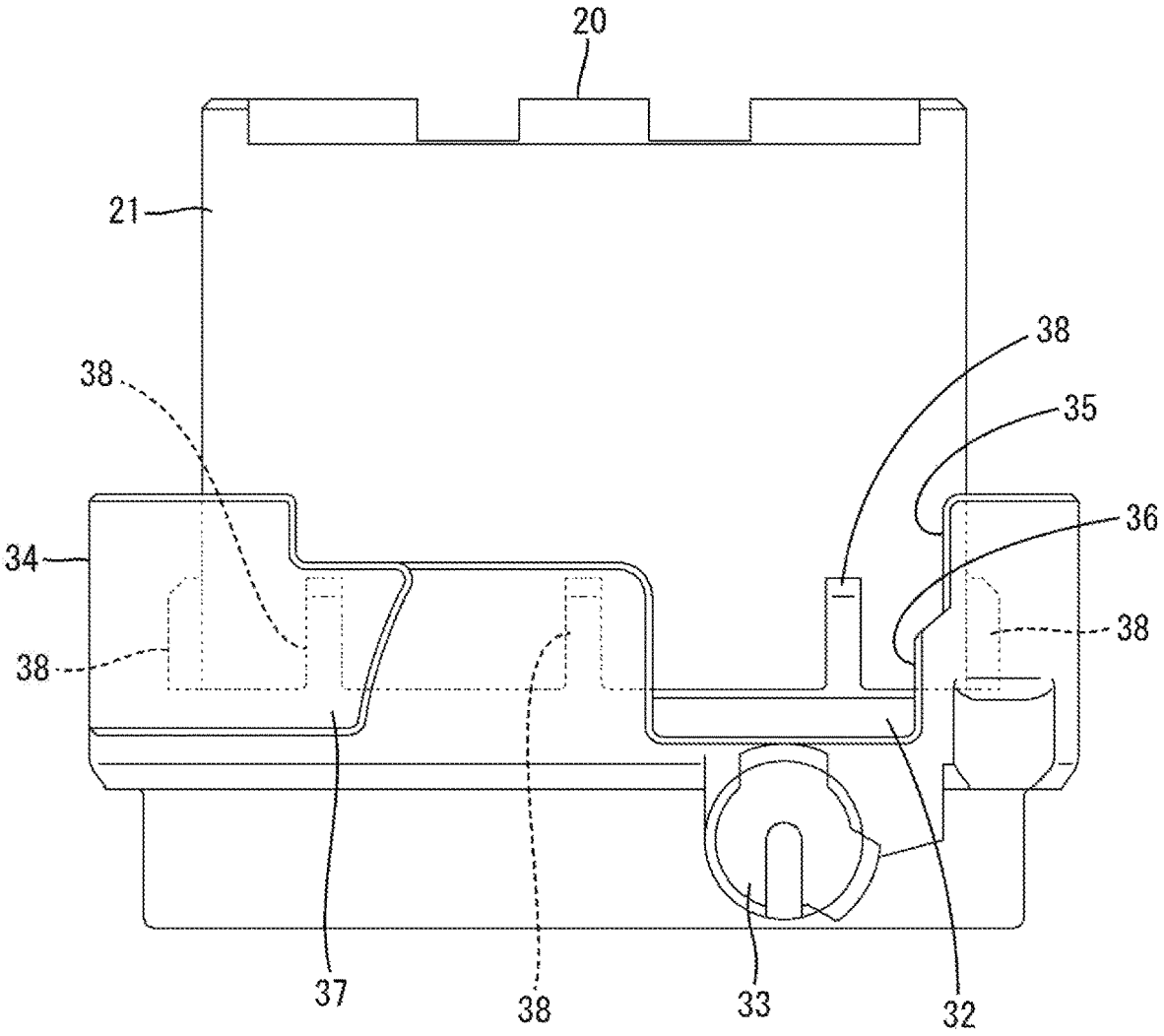
FIG. 6 is a bottom view of the housing of the non-waterproof connector.
Figure 7:
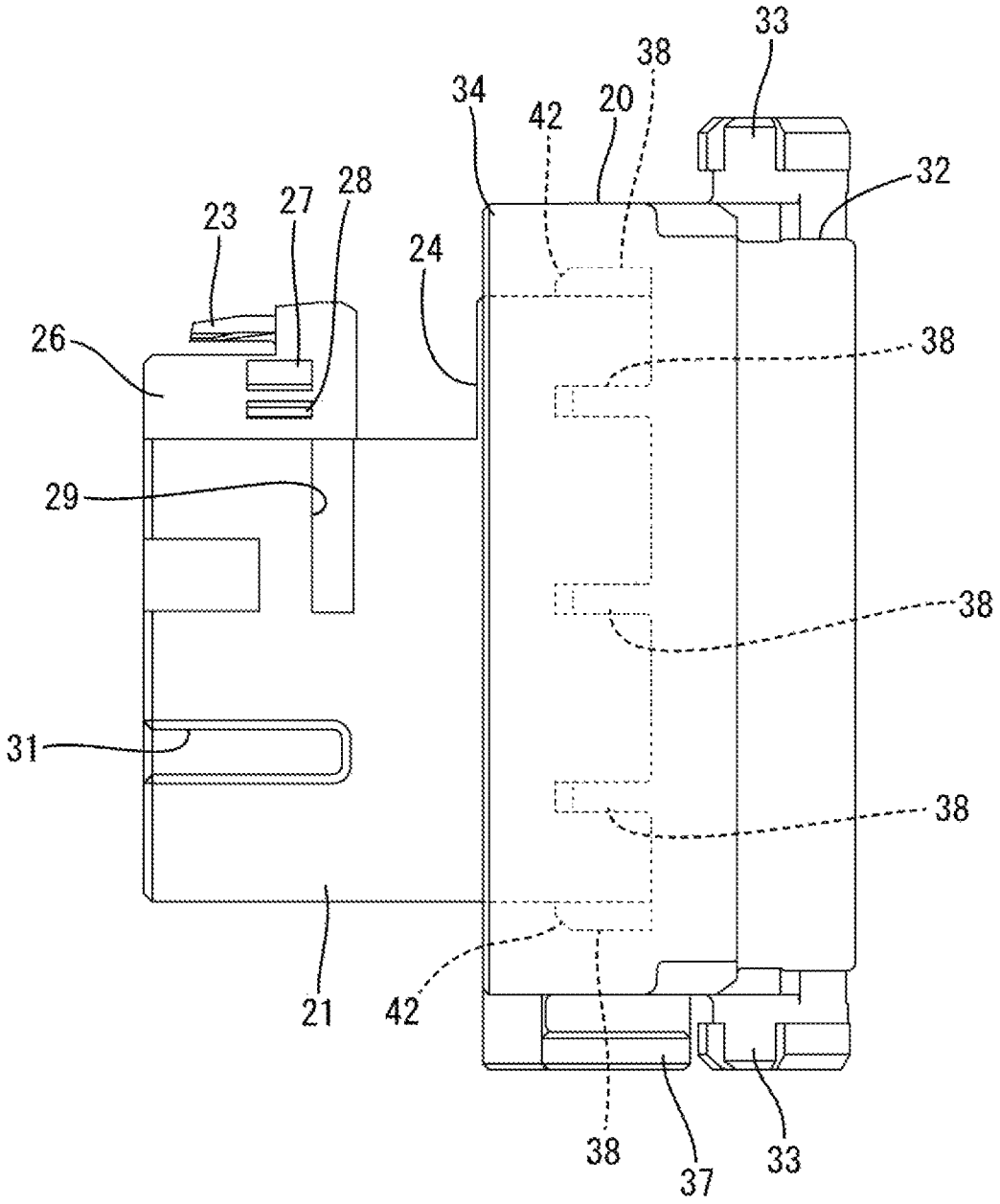
FIG. 7 is a side view of the housing of the non-waterproof connector.

The housing 20 is made of synthetic resin and includes, as shown in FIGS. 4 to 7, a housing body 21 in the form of a block. Cavities 22 penetrate through the housing body 21 in the front-rear direction. As shown in FIGS. 2 and 5, a locking lance 23 is provided to project forward at an upper wall part of the inner surface of each cavity 22. As shown in FIGS. 1, 4 and 7, the cavities 22 in an uppermost stage are formed by cutting an outer wall part covering a front part upper surface, and exposed. As shown in FIG. 2, the terminal fittings 90 are inserted into each cavity 22 from behind. Each terminal fitting 90 is resiliently locked and primarily retained by the locking lance 23 in each cavity 22.

Further, as shown in FIG. 2, a retainer mounting hole 24 is open at a position near a center in the front-rear direction in the upper surface of the housing body 21. The retainer mounting hole 24 extends down from an opening 25 open in the upper surface of the housing body 21 and intersects and communicates with the respective cavities 22. The retainer 60 is inserted into the retainer mounting hole 24 through the opening 25 from above.

As shown in FIG. 5, recesses 26 recessed inwardly in a stepped manner with respect to a lower side are provided in upper end parts of both left and right side surfaces of the housing body 21. As shown in FIG. 7, upper end parts of both side surfaces of the retainer mounting hole 24 are open in the recesses 26.

A partial lock receiving portion 27 and a full lock receiving portion 28 are arranged vertically in the recess 26 of the housing body 21. The partial lock receiving portion 27 and the full lock receiving portion 28 are both in the form of ribs extending in the front-rear direction, and are lockable to a later-described locking portion 66 of the retainer 60.

A lock receiving groove 29 is provided in each of left and right side surfaces of the housing body 21. Each lock receiving groove extends in the vertical direction and has an upper end open in the lower edges of the recesses 26. The lock receiving grooves 29 are lockable to unillustrated locking projections of the front mask 70.

A recess 31 is open at a position between the cavities 22 in two lower stages in lower end parts of each of the left and right side surfaces of the housing body 21. As shown in FIGS. 1 and 5, each recess 31 extends in the front-rear direction and is in the form of a slit open in the front surface of the housing body 21.

A base mount portion 32 is provided circumferentially on a rear end part of the outer surface of the housing body 21 and projects out in a stepped manner with respect to a front side. A support shaft 33 project on a rear end part of each of the upper and lower surfaces of the base mount portion 32. Each support shaft 33 is arranged eccentrically from a lateral center of the housing 20. The lever 80 is supported rotatably on each support shaft 33.

The housing 20 is provided with a tubular fitting 34 projecting a short distance forward after protruding outward from the base mount portion 32. As shown in FIGS. 4 and 6, a recess 35 is provided in the front end of each of the upper and lower walls of the fitting 34 and is recessed rearward, while leaving both left and right sides. Further, an escaping recess 36 is in front of the support shaft 33 in each of the upper and lower walls of the fitting 34 and is recessed rearward from the back end of the recess 35. The corresponding cam follower 124 can escape into each escaping recess 36 when the housings 20, 120 are connected. As shown in FIGS. 5 and 6, the lower wall of the fitting 34 is provided with an outer wall 37 facing at a distance from the outer surface of this lower wall.

As shown in FIGS. 2 to 4, restricting portions 38 project on the outer surface of the housing body 21 at positions rearward of the opening 25 of the retainer mounting hole 24. Each restricting portion 38 is a rib extending with a constant width in the front-rear direction and having a rear end integrally coupled to the front surface (stepped surface) of the base mount portion 32.

As shown in FIG. 5, the respective restricting portions 38 are arranged at intervals in a circumferential direction on the outer surface of the housing body 21. Specifically, three restricting portions 38 are arranged on each of four surfaces of the housing body 21, more particularly arranged on a laterally central part and both left and right end parts of each of the upper and lower surfaces of the housing body 21 and on a vertically central part and both upper and lower end parts of each of the left and right side surfaces of the housing body 21.

As shown in FIG. 7, the three restricting portions 38 provided on each of the both left and right side surfaces of the housing body 21 are covered from outside by both left and right side walls of the fitting portion 34 and cannot be seen laterally. On the other hand, as shown in FIGS. 4 and 6, out of the three restricting portions 38 provided on each of the both upper and lower surfaces of the housing body 21, one restricting portion 38 on an end side can be vertically visually confirmed through the escaping recess 36 of the fitting portion 34. Of course, the visually confirmable restricting portions 38 are also covered from outside by cam plate portions 81 to be described later and cannot be seen vertically by mounting the lever 80 on the support shafts 33.

Each restricting portion 38 has a substantially rectangular cross-section and has, as shown in FIG. 3, an outer end surface 39 extending along the front-rear direction, a front end surface 41 extending in the vertical direction and a tapered retracting surface 42 inclined gradually outward from the front end surface 41 to the outer end surface 39. In other words, the retracting surface 42 is formed by chamfering a front end corner part of the restricting portion 38. Further, the outer end surface 39 of each restricting portion 38 and the back surface of the fitting portion 34 are linked via a slope 43 having a gentler angle of inclination than the retracting surface 42 in the front-rear direction.

The terminal fitting 90 is made of conductive metal, includes a box portion 91 having a box-like shape and a barrel portion 92 in the form of an open barrel connected behind the box portion 91 as shown in FIG. 2, and is long and narrow in the front-rear direction as a whole. The terminal connecting portion 191 of the mating terminal fitting 190 is inserted and connected to the box portion 91. The barrel portion 92 is crimped and connected to an end part of a wire 50.

The retainer 60 is made of synthetic resin and includes, as shown in FIG. 1, a retainer body 61 extending in the vertical and lateral directions and having a predetermined thickness in the front-rear direction, an operating portion 62 in the form of a flat plate protruding both forward and rearward from an upper end part of the retainer body 61, and a pair of locking piece portions 63 hanging down from both left and right end parts of the operating portion 62 and having rear parts united with both left and right side surfaces of the retainer body 61.

The retainer body 61 is inserted into the retainer mounting hole 24. Through holes 64 penetrate the retainer body 61 in the front-rear direction at positions corresponding to the respective cavities 22 (excluding the cavities 22 in a lowermost stage). A retaining portion 65 project at an upper wall part of the inner surface of each through hole 64. Retaining portions 65 also are provided side by side on a lower end part of the retainer body 61 in correspondence with the respective cavities 22 in the lowermost stage.

A pair of locking portions 66 are provided on the inner surfaces of the respective locking piece portions 63 facing each other. A lower end part of the locking portion 66 is formed into a claw lockable to each of the partial lock receiving portion 27 and the full lock receiving portion 28. The retainer 60 is held at each of a partial locking position where the lower end parts of the locking portions 66 are locked to the partial lock receiving portions 27 and a full locking position where the lower end parts of the locking portions 66 are locked to the full lock receiving portions 28.

At the partial locking position, the operating portion 62 projects a large distance up from the opening 25 of the retainer mounting hole 24, each retaining portion 65 is retracted from each cavity 22, and the insertion of the terminal fitting 90 into each cavity 22 is allowed. As shown in FIG. 2, at the full locking position, the operating portion 62 projects slightly up from the opening 25 of the retainer mounting hole 24 and each retaining portion 65 is inserted in the cavity 22 to face the rear end of the box 91 of the terminal fitting 90 inserted into the cavity 22. Thus, each terminal fitting 90 is retained secondarily.

The operating portion 62 can be pressed down when the retainer 60 is at the partial locking position. Thus, the locking pieces 63 are deflected and deformed to release locking between the locking portions 66 and the partial lock receiving portions 27, and the retainer 60 moves down toward the full locking position. When the retainer 60 reaches the full locking position, the locking pieces 63 resiliently return to fit into the recesses 26, and the locking portions 66 and the full lock receiving portions 38 are locked. When the retainer 60 is at the full locking position, the flat upper surface of the operating portion 62 is at the same position as the upper surfaces of the restricting portions 38 arranged on the upper surface of the housing body 21 or at a position slightly higher than the upper surfaces of the respective restricting portions 38, as shown in FIGS. 2 and 3.

The front mask 70 is made of synthetic resin and includes, as shown in FIG. 1, a front wall 71 substantially in the form of a rectangular plate extending along the vertical and lateral directions and a peripheral wall 71 substantially in the form of a rectangular tube projecting rearward from an outer end part of the front wall 71.

The front wall 71 covers the front surface of the housing body 21. Insertion holes 73 penetrate the front wall 71 in the front-rear direction at positions corresponding to the cavities 22. The terminal connecting portion 191 of each mating terminal fitting 190 is inserted into each insertion hole 73 of the front wall 71 from behind when the housings 20, 120 are connected. As shown in FIG. 2, the front wall 71 covers and protects each locking lance 23.

As shown in FIG. 1, two recessed grooves 74 are provided at positions corresponding to the respective recessed portions 31 of the housing body 21 in both left and right side panels 75 of the peripheral wall 72. Each recessed groove 74 is in the form of a slit extending in the front-rear direction and is open in the front surface of the front wall 71. The corresponding projection 123 is inserted and arranged in each recessed groove 74 when the housings 20, 120 are connected to ensure a state where the housing 20 is connected in a proper posture in the corresponding receptacle 122.

Further, two unillustrated locking projections extend vertically on the inner surfaces of the left and right side panels 75 of the peripheral wall 72. The respective locking projections are locked resiliently to the respective lock receiving grooves 29 of the housing body 21 to hold the front mask 70 on the housing body 21.

The peripheral wall 72 is arranged to cover front parts of four sides of the outer surface of the housing body 21. The left and right side panels 75 of the peripheral wall 72 cover the respective locking pieces 63 of the retainer 60 to restrict opening deformation of the respective locking piece portions 63 and, hence, to enhance locking reliability of the locking portions 66. Cuts 77 into which the operating portion 62 of the retainer 60 is to be inserted with the front mask 70 mounted on the housing 20 provided between an upper wall 76 and the left and right side panels 75 of the peripheral wall 72.

The lever 80 also is made of synthetic resin and has a U-shape formed by upper and lower cam plates 81 and a coupling 82 that links the respective cam plates 81, as shown in FIG. 1. Each cam plate 81 has a bearing hole 83 for receiving the support shaft 33 and a cam groove 84 that is open in an outer peripheral edge. A deflectable partial locking piece 85 is cantilevered between the bearing hole 83 and the cam groove 84 on the outer peripheral edge of each cam plate 81.

A deflectable lock 86 is cantilevered rearward on the upper cam plate 81. A claw-like lock projection 87 is provided on the upper surface of the lock 86. A thin entering edge 88 is provided on the outer periphery of the lower cam plate 81.

The lever 80 is arranged to straddle the housing 20 from behind, and the support shafts 33 fit in the respective bearing holes 83. Thus, the lever 80 is rotatable about the support shafts 33 with respect to the housing 20 the partial locking position and the full locking position. At this time, the cam plates 81 cover both upper and lower walls of the fitting portion 34.

At the partial locking position, the partial locking pieces 85 contact an edge of the fitting portion 34 to restrict rotation of the lever 80 to the full locking position. The releasing portions 125 release locking between the partial locking pieces 85 and the fitting portion 34 when the connection of the housings 20, 120 is started so that the lever 80 can rotate to the full locking position. Further, the cam followers 124 enter the respective cam grooves 84 through the escaping recesses 36 when the connection of the housings 20, 120 is started.

The lever 80 is rotated toward the full locking position while gripping the coupling 82. Thus, the cam followers 124 slide on groove surfaces of the respective cam grooves 84 and a cam mechanism acts between the lever 80 and the mating housing 120 so that a connecting operation of the housings 20, 120 proceeds. When the lever 80 reaches the full locking position, the lock projection 87 of the lock portion 86 is fit resiliently into the lock hole 129 to restrict the rotation of the lever 80 (see FIG. 2). Further, at the full locking position, the respective cam followers 124 move to back sides of the respective cam grooves 84 and the housings 20, 120 are connected to a proper depth. Simultaneously, the terminal fittings 90, 190 achieve proper electrical connection. While the lever 80 is rotated, the entering edge 88 of the lower cam plate 81 can contact each of the lower cover 131 and the outer wall 37 by being inserted into inner spaces of the lower cover 131 and the outer wall 37. Further, the upper cam plate 81 can contact the upper cover 128 by being inserted into an inner space of the upper cover 128. In this way, outward expanding deformation of the respective cam plate portions 81 is prevented.

In the case of the non-waterproof connector 10, the part of the outer surface of the housing body 21 forward of the retainer mounting hole 24 is covered by the peripheral wall 72 and the front panel 71 of the front mask 70, and the part rearward of and near the retainer mounting hole 24 is covered by rear parts of the operating portion 62 and the peripheral wall 72.

Further, the rear side of the retainer mounting hole 24 on the outer surface of the housing body 21 is provided with the restricting portions 38 in a part near the base mount portion 32. The respective restricting portions 38 on an upper side are arranged side by side with the upper panel 76 of the peripheral wall 72 and the operating portion 62 in the front-rear direction, and the restricting portions 38 on lower, left and right sides are arranged side by side with a lower wall 78 and the both left and right side walls 75 of the peripheral wall 72 in the front-rear direction. Further, the outer end surfaces 39 of the respective restricting portions 38 on the upper side are coplanar with the outer surface of the upper panel 76 of the peripheral wall 72 and the outer surface of the operating portion 62, and the outer end surfaces 39 of the respective restricting portions 38 on the lower, left and right sides are coplanar with the outer surface of the lower panel 78 of the peripheral wall 72 and the outer surfaces of the left and right side walls 75.

When the housing 20 is fit into the receptacle 122, the inner surface of the receptacle 122 is arranged to contact along the outer surfaces of the peripheral wall 72 and the operating portion 62 and along the outer end surfaces 39 of the respective restricting portions 38, as shown in FIG. 3. The guiding surface 126 of the receptacle 122 is arranged to contact along the slope 43 of the housing 20. Thus, the housing 20 is fit into the receptacle 122 with rattling suppressed.

The restricting portions 38 are in contact with or near the inner surface of the opening end of the receptacle 122 between the rear end of the operating portion 62 and the base mount portion 32 and between the rear end of the peripheral wall 72 and the base mount portion 32. Thus, loose movements of the opening end part of the receptacle 122 with respect to the housing 20 can be suppressed effectively. In addition, since the respective restricting portions 38 are provided at intervals in the circumferential direction on the four surfaces of the housing 20, the rattling of the connectors 10, 100 can be suppressed effectively in all directions.

Further, the retracting surfaces 42 prevent the opening end of the receptacle 122 from butting against front corner parts of the restricting portions 38 in the process of connecting the housings 20, 120. Thus, the connection of the housings 20, 120 can proceed smoothly. Here, even if connecting postures of the housings 20, 120 are inclined with respect to the front-rear direction, the opening end part of the receptacle 122 slides on the retracting surfaces 42 and the inclined postures of the housings 20, 120 are corrected.

[Waterproof Connector 10A]

Figure 8:
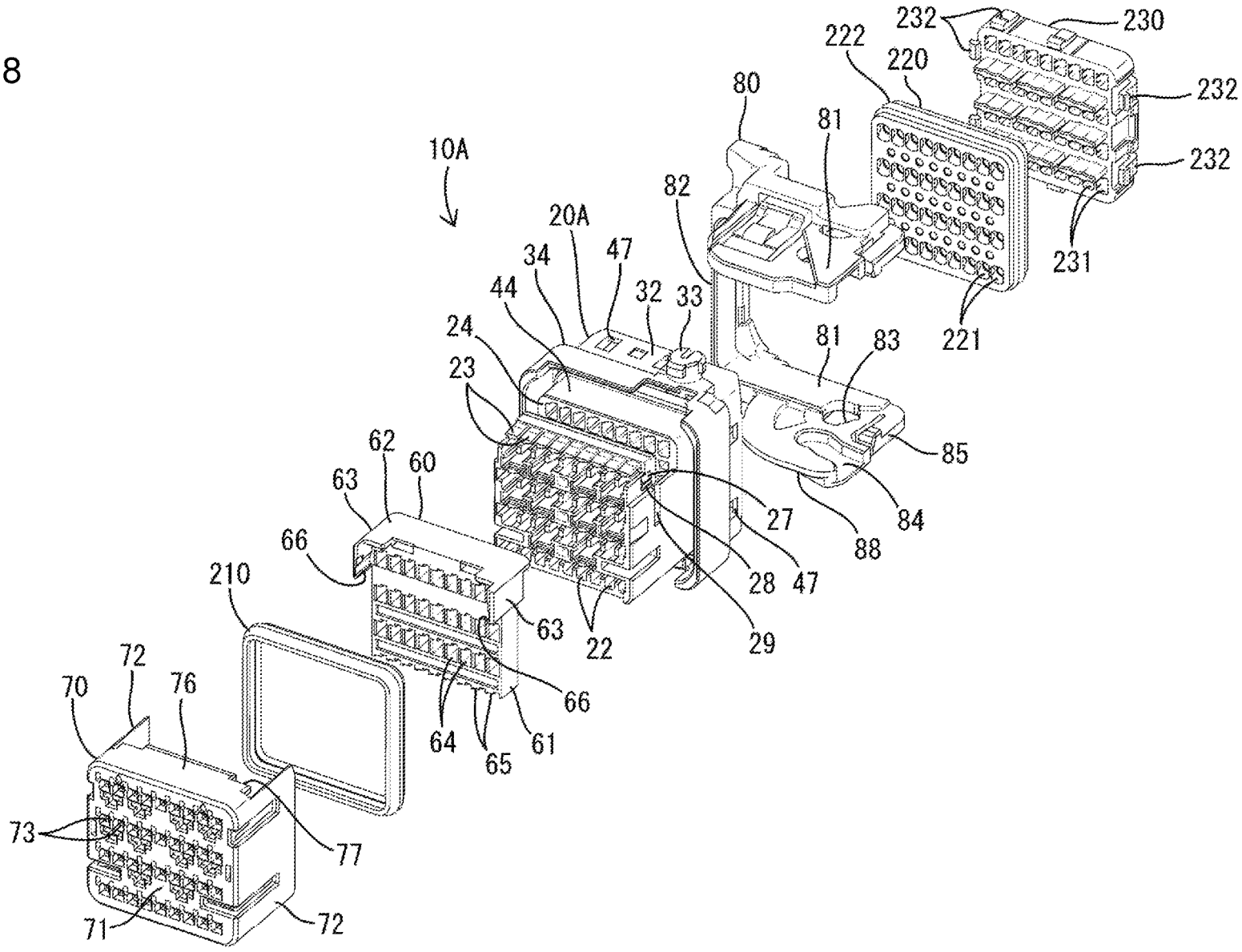
FIG. 8 is an exploded perspective view of a waterproof connector.
Figure 9:
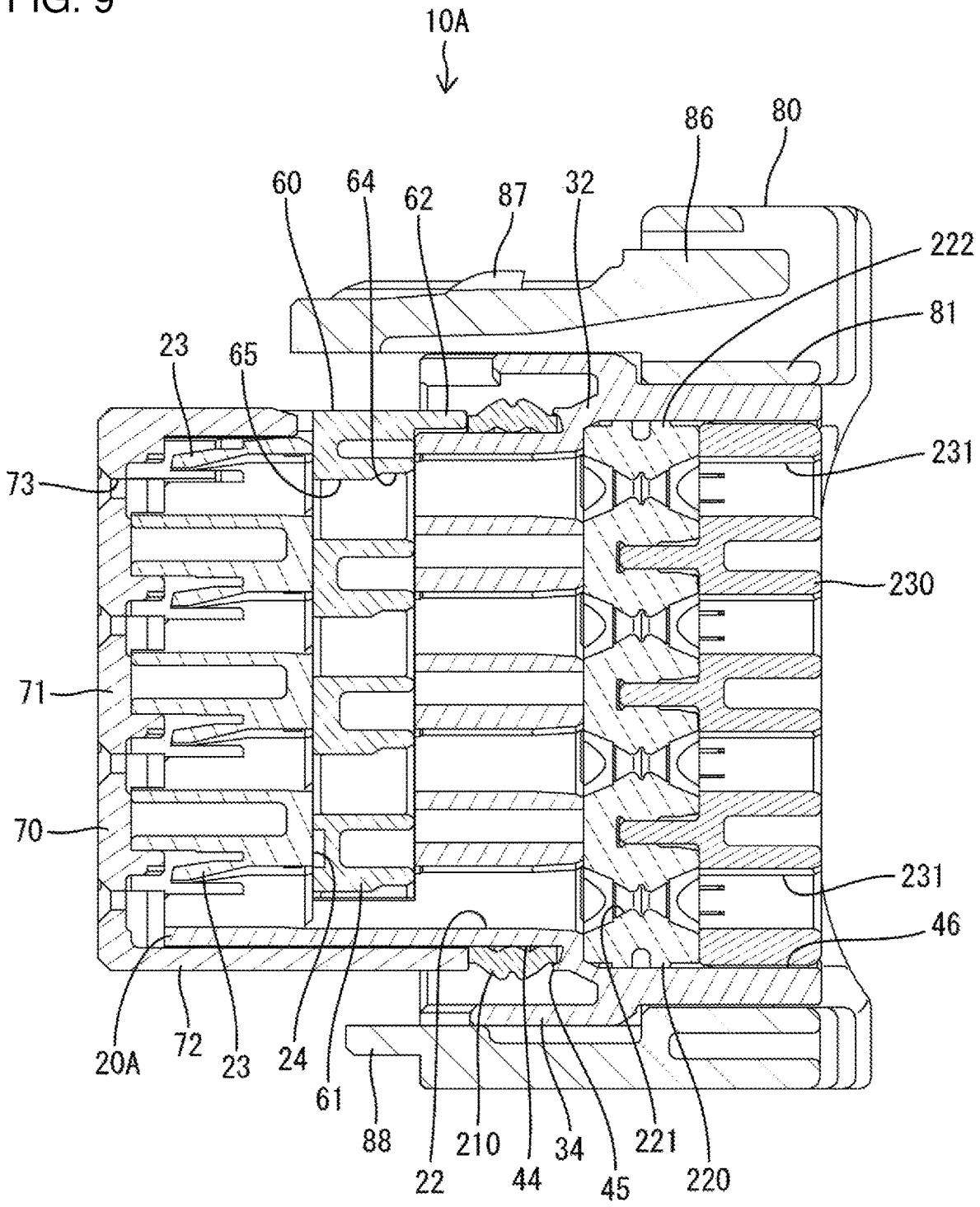
FIG. 9 is a section of the waterproof connector.

As shown in FIGS. 8 and 9, the waterproof connector 10A includes a housing 20A, a retainer 60, a front mask 70, a lever 80, a seal ring 210, a one-piece rubber plug 220, a rear holder 230 and terminal fittings 90 (see FIG. 9). The retainer 60, the front mask 70, the lever 80 and the terminal fittings 90 have the same shapes as those of the non-waterproof connector 10. Thus, these members can be used in the non-waterproof connector 10 and the waterproof connector 10A. The housing 20A includes many parts common to the housing 20 of the non-waterproof connector 10 and has substantially the same shape as the housing 20, except at a rear side of a retainer mounting hole 24. That is, mounting areas of the retainer 60, the front mask 70 and the lever 80 have common structures for the housings 20 and 20A, and can be used as common components. Note that the following description of the structure of the housing 20A focuses on parts of the housing 20 of the non-waterproof connector 10 that are different. Further, parts substantially the same as or equivalent to those of the non-waterproof connector 10 are denoted by the same reference signs.

The housing 20A has a sealing surface 44 extending along the front-rear direction behind the retainer mounting hole 24 on the outer surface of a housing body 21. The sealing surface 44 of the housing body 21 is a flat continuous surface without any step and is held in close contact with the seal ring 210. The seal ring 210 is made of rubber, has a substantially rectangular ring shape in a front view and fits on the outer surface of the housing body 21. A pressing piece 45 projects a short distance forward on an outer end part of the front surface (stepped surface) of a base mount portion 32. As shown in FIG. 9, the seal ring 210 is held in close contact with the sealing surface 44 and has an outward positional deviation restricted by the pressing piece 45.

A rubber plug accommodating portion 46 is open in a rear surface in a rear part of the housing body 21. The back surface of the rubber plug accommodating portion 46 is slightly behind the sealing surface 44 in the front-rear direction and serves as an opening surface on the rear end of each cavity 22.

The rubber plug 220 is a mat extending along the vertical and lateral directions and has a predetermined thickness in the front-rear direction. The rubber plug 220 is inserted into the rubber plug accommodating portion 46 from behind. Sealing holes 221 penetrate the rubber plug 220 in the front-rear direction at positions corresponding to the respective cavities 22. Outer peripheral lips 222 are provided circumferentially on the outer peripheral surface of the rubber plug 220.

The rear holder 230 is made of synthetic resin, extends along the vertical and lateral directions and has a predetermined thickness in the front-rear direction. Insertion holes 231 penetrate the rear holder 230 in the front-rear direction at positions corresponding to the respective cavities 22 and the sealing holes 221. Rear holder locks 232 are provided on upper and lower surfaces and left and right side surfaces of the rear holder 230. Rear holder lock receiving portions 47 penetrate through rear end parts of left and right side surfaces of the housing body 21 at positions corresponding to the rear holder locks 232.

The rubber plug 220 and the rear holder 230 are inserted successively into the rubber plug accommodating portion 46 of the housing body 21 (see FIG. 9). The rear holder locks 232 resiliently lock the respective rear holder lock receiving portions 47 to hold the rear holder 230 in the housing body 21 and to prevent an escape of the rubber plug 220 from the rubber plug accommodating portion 46.

Although not shown, the terminal fitting 90 (see FIG. 2) is inserted into the cavity 22 from the insertion hole 231 of the rear holder 230 by way of the sealing hole 221 of the rubber plug 220. When the terminal fitting 90 is inserted properly into the cavity 22, the wire 50 connected to the terminal fitting 90 is held resiliently in close contact with the inner peripheral surface of the sealing hole 221 and sealing is provided around the wire 50. Further, the outer peripheral lips 222 of the rubber plug 220 are held resiliently in close contact with the inner peripheral surface of the rubber plug accommodating portion 46 so that sealing is provided in the rubber plug 46 and eventually in the housing 20A.

The seal ring 210 is fit on the sealing surface 44 of the housing body 21 from the front. The seal ring 210 is arranged while being positioned in the front-rear direction between the base mount portion 32 and the operating portion 62. When the housings 20A, 120 are connected, the inner surface of the receptacle 122 is held resiliently in close contact with the seal ring 210 and the seal ring 210 is sandwiched between the receptacle 122 and the housing body 21 to provide sealing between the housings 20A, 120. In this way, the waterproofing of the waterproof connector 10A is ensured.

As described above, the retainer 60, the front mask 70 and the lever 80 are used as common components of the waterproof connector 10A and the non-waterproof connector 10. Further, the mounting area of the retainer 60 including the retainer mounting hole 24, the mounting area of the front mask 70 and the mounting area of the lever 80 including the support shafts 33 have the same shapes in the housing 20A of the waterproof connector 10A and the housing 20 of the non-waterproof connector 10. As a result, manufacturing cost, management cost and the like can be saved and a cost reduction can be realized.

Other embodiments are briefly described below.

The front mask can be omitted from either one of the non-waterproof connector and the waterproof connector.

The lever can be omitted from either one of the non-waterproof connector and the waterproof connector.

In the waterproof connector, individual rubber plugs to be individually fit on the wires of the respective terminal fittings may be used instead of the one-piece rubber plug. In the case of using the individual rubber plugs, the rear holder is unnecessary and the rubber plug accommodating portion can be omitted from the housing.

The restricting portions need not be provided on each of four sides.

The restricting portion may strongly come into contact with the inner surface of the receptacle and be partially squeezed when the housings are connected.

LIST OF REFERENCE SIGNS

10 . . . non-waterproof connector
10A . . . waterproof connector
20 . . . housing (non-waterproof connector)
20A . . . housing (waterproof connector)
22 . . . cavity
24 . . . retainer mounting hole
38 . . . restricting portion

42 . . . retracting surface
44 . . . sealing surface
60 . . . retainer
70 . . . front mask
80 . . . lever
90 . . . terminal fitting
100 . . . mating connector
120 . . . mating housing
122 . . . receptacle
210 . . . seal ring

What is claimed is:

1. A connector, comprising:

a housing extending between front and back ends and including an outer surface with at least one restricting portion in the form of a rib projecting therefrom and extending with a constant rib in a front-rear direction, a cavity into which a terminal fitting is insertable, and a retainer mounting hole open in the outer surface of the housing and communicating with the cavity;

a retainer inserted into the retainer mounting hole and configured to retain and lock the terminal fitting in the cavity, the retainer having an outer surface aligned with an outer edge of the at least one restricting portion; and a mating housing having a receptacle into which at least the front end of the housing is inserted, wherein an inner surface of the receptacle contacts the outer surface of the retainer and the upper edge of the at least one restricting portion when the housing accommodated in the receptacle.

2. The connector of claim 1, further comprising a front mask mounted on the housing to cover an area on the front end of the outer surface of the housing.

3. The connector of claim 1, wherein the at least one restricting portion comprises plural restricting portions provided at intervals in a circumferential direction on the outer surface of the housing.

4. The connector of claim 3, wherein a chamfered retracting surface is provided on a front surface of each of the restricting portions.

5. A connector structure with a non-waterproof connector and a waterproof connector, wherein:

both the non-waterproof connector and the waterproof connector have a housing with a front end to be fit into a receptacle of a mating housing and including cavity into which a terminal fitting is insertable, a retainer mounting hole open in an outer surface of the housing and communicating with the cavity, and a retainer having an outer surface, the retainer to be inserted into the retainer mounting hole and configured to retain and lock the terminal fitting in the cavity;

the non-waterproof connector further includes at least one restricting portion in the form of a rib projecting on the outer surface of the housing at a position rearward of the retainer mounting hole and extending with a constant width in a front rear direction, and configured to contact an inner surface on an opening side of the receptacle in a fitting state;

the waterproof connector further includes a seal ring to be fit on the outer surface of the housing at a position rearward of the retainer mounting hole, and configured for resiliently contacting an inner surface on an opening side of the receptacle in a fitting state; and the outer surface of the retainer is aligned with an outer edge of the at least one restricting portion and an outer edge of the seal ring and contacts the inner surface of the receptacle.

6. The connector structure of claim 5, further comprising a front mask mounted on the housing to cover an area on the outer surface of the housing forward of the retainer mounting hole in both the non-waterproof connector and the waterproof connector; and the respective front masks of the non-waterproof connector and the waterproof connector have identical shapes.

7. The connector structure of claim 6, further comprising:

a support shaft projecting on a rear end part of the outer surface of the housing and a lever rotatably supported on the support shaft in both the non-waterproof connector and the waterproof connector and configured to urge the housing into the receptacle is; and the respective levers of the non-waterproof connector and the waterproof connector have identical shapes.

* * * * *